United States Patent [19]

Nnadi

[11] 4,083,792

[45] Apr. 11, 1978

[54] OVERBASED METAL COMPLEXES AND COMPOSITIONS THEREOF WITH LUBRICANTS

[75] Inventor: John C. Nnadi, Lagos, Nigeria

[73] Assignee: Mobil Oil Corporation, New York, N.Y.

[21] Appl. No.: 646,127

[22] Filed: Jan. 2, 1976

[51] Int. Cl.[2] ..... C10M 3/18

[52] U.S. Cl. ..... 252/18; 252/25; 252/42.7; 252/46.7; 252/400 R; 252/400 A

[58] Field of Search ..... 252/18, 25, 33, 33.4, 252/40.5, 42.7, 46.4, 46.7, 400 R, 400 A

[56] References Cited

U.S. PATENT DOCUMENTS

| | | | |
|---|---|---|---|
| 2,263,445 | 11/1941 | Reiff | 252/47.5 X |
| 2,345,239 | 3/1944 | Cook et al. | 252/47.5 X |
| 2,346,808 | 4/1944 | Winning et al. | 252/47.5 X |
| 2,692,859 | 10/1954 | Talley et al. | 252/32.5 X |
| 2,695,910 | 11/1954 | Asseff et al. | 252/32.5 X |
| 2,721,176 | 10/1955 | Cantrell et al. | 252/46.4 |
| 2,848,444 | 8/1958 | Brugmann et al. | 252/47 |
| 3,105,049 | 9/1963 | Voorhees | 252/18 X |
| 3,262,880 | 7/1966 | Voorhees | 252/18 X |
| 3,544,463 | 12/1970 | Koft | 252/32.5 X |
| 3,632,600 | 1/1972 | Morris | 252/33 |

*Primary Examiner*—Delbert E. Gantz
*Assistant Examiner*—Andrew H. Metz
*Attorney, Agent, or Firm*—Charles A. Huggett; Dennis P. Santini

[57] ABSTRACT

Oil-soluble overbased metallic compounds of polyarylamine sulfides and polyarylamine-phenol sulfides are provided. Said overbased compounds function as dispersants and lubricants are stabilized against oxidation and have their wear protection properties improved by adding thereto a property improving amount of one or more of said overbased compounds.

16 Claims, No Drawings

OVERBASED METAL COMPLEXES AND COMPOSITIONS THEREOF WITH LUBRICANTS

BACKGROUND OF THE INVENTION

1. Field of the Invention

The present invention relates to a new class of compounds identified as overbased metallic compounds of polyarylamine sulfides and polyarylamine-phenol sulfides. It further relates to improved lubricant compositions. More particularly, it relates to lubricants which have been improved by the addition thereto of one or more of said overbased compounds.

2. Discussion of the Prior Art

It is well known that many organic liquids and solids used in industrial fluids, such as oils and greases, power transmission fluids and the like, may deteriorate and lose their ability to function when subjected to oxidation. Since these substances are very often used at high temperatures, the rate of oxidation breakdown can be very rapid. This problem is particularly important in the operation of present day automotive and aircraft engines.

The breakdown of lubricant is almost always accompanied by the formation of sludge, corrosive acids and other products. These can harm the metal surfaces of engines or other machines and interfere with efficient operation of the lubricant.

No art is known which discloses the overbased compounds taught herein. There are numerous other compounds, however, taught in the art which impart property improvement to lubricants in combination therewith. For instance, U.S. Pat. Nos. 3,156,728 and 3,224,972 teach 4,4-thiobis[2,6-di(lower alkyl)aniline] compounds for the purpose of imparting antioxidant properties to organic compositions therewith. Further, U.S. Pat. No. 2,848,444 teaches lubricant compositions containing a reaction product of a metal polysulfide and diphenylamine, or an alkyl derivative thereof, having improved oxidation and corrosion properties. U.S. Pat. No. 3,217,038 teaches the use of an alkylthioalkyl diaminodiphenylalkane for the purpose of imparting stabilization to an organic substance by mixture therewith. Also, U.S. Pat. No. 3,347,792 teaches lubricant compositions containing a reaction product of (1) ammonia, a primary amine or a secondary amine with (2) carbon disulfide and (3) an aliphatic epoxide.

U.S. Pat. No. 3,844,956 relates to improving lubricants by adding thereto an amount of an amino-substituted polyphenylthioether, an intermediate compound in the manufacture of the compounds of the present invention.

SUMMARY OF THE INVENTION

In accordance with this invention, there is provided the new class of oil-soluble compounds identified as overbased metallic compounds of polyarylamine sulfides and polyarylaminephenol sulfides. The metallic compounds of polyarylamine sulfides and polyarylamine-phenol sulfides, prior to overbasing, have the general chemical formula:

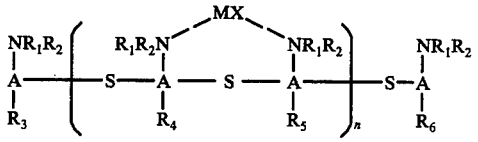

In the above formula, $n$ is an integer of from 1 to about 10, preferably from 1 to about 5;

A is an aromatic moiety, preferably phenyl or naphthyl;

M is a polyvalent metal, such as, for example, Be, Mg, Ca, Ba, Mn, Co, Ni, Pd, Cu, Zn and Cd;

X is a radical selected from the group consisting of organophosphoro, organocarboxyl, organoamino, organosulfonyl, organothio, organooxy, nitrate, nitrate, phosphate, sulfate, sulfonate, oxide, hydroxide, carbonate, sulfite, flouride, chloride, bromide and iodide;

$R_1$ and $R_2$ are alkyl of from 1 to about 10 carbon atoms, aryl, hydrogen,

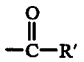

or a combination thereof;

R′ if alkyl of from 1 to about 10 carbon atoms, aryl or hydrogen;

$R_3$, $R_4$, $R_5$ and $R_6$ are hydrogen, alkyl of from 1 to about 200 carbon atoms, aryl, alkyl-substituted aryl where the alkyl substituent is comprised of from 1 to about 200 carbon atoms, carboxyaryl, carbonylaryl, aminoaryl, mercaptoaryl, halogenoaryl or combinations thereof.

It is noted that the $—NR_1R_2$ functions in the above chemical formula may be the same or different within an individual molecule of the compound.

The present oil-soluble overbased compounds may be obtained by reacting one or more of the above-identified compounds with one or more basic metallic compounds such as, for example, $Ca(OH)_2$ or $Ba(OH)_2$, in the presence of a promoter such as, for example, methanol.

Also in accordance herewith, there is provided a lubricant composition comprising a major proportion of a lubricant and an antioxidant or detergency improving amount of one or more of the above compounds in overbased form.

DESCRIPTION OF SPECIFIC EMBODIMENTS

The overbased compounds of the present invention are those made by the method of reacting a compound of the above formula with a suitable overbasing reactant such as, for example, $Mg(OH)_2$, $Ca(OH)_2$, $Ba(OH)_2$, NaOH, KOH, LiOH and/or $Sr(OH)_2$ under reaction conditions described in, for example, U.S. Pat. Nos. 3,801,507; 3,446,736 or 3,436,347.

U.S. Pat. No. 3,844,956, the disclosure of which is incorporated herein by reference, shows preparation of an intermediate useful in preparation of the compounds represented by the above formula. U.S. application Ser. No. 558,022, filed Mar. 13, 1975, the disclosure of which is incorporated herein by reference, shows preparation of the compounds represented by the above formula which are useful in preparation of the present overbased compounds. Said compounds may be reacted with suitable metallic salts (e.g. calcium hydroxide) to yield the present overbased compounds.

The overbased compounds of this invention can be used in a wide variety of lubricant media either singly or in combination with another of such compounds. They can be used as effective agents in lubricating oils such as mineral oils, both napthenic and paraffinic, including those containing substantial amounts of aromatic oils, synthetic oils such as synthetic hydrocarbons obtained by polymerizing olefins, synthetic esters and polysiloxanes and the like. The term "lubricant" also includes greases made by adding a grease forming agent to any of those oils mentioned, but is not meant to include any of the compounds themselves as lubricants. The compounds disclosed herein are especially useful in providing detergency and in stabilizing a lubricating oil made by reacting an aliphatic monocarboxylic acid containing from 4 to 10, preferably 5 to 9, carbon atoms with pentaerythritol, including mono and dipentaerythritol or mixtures thereof. A widely used synthetic lubricating oil is made from monopentaerythritol and a mixed $C_5$–$C_9$ acid, preferably $C_5$ and $C_9$.

For the purpose of non-limiting illustration of the present invention, the following examples are presented.

EXAMPLE 1

One mole (262 grams) of dodecyaniline was dissolved in 262 grams of Promor No. 5 process oil and then neutralized with hydrogen chloride gas until the theoretical amount of HCl (36.5 grams) was taken up. To the above dodecylaniline hydrochloride was added 76.5 grams of sulfur dichloride (about 0.75M) at such a rate as to keep the reaction temperature at 30°–70° C. The temperature was slowly raised to 150° C during a period of 6 hours and kept at 150° C for 4 hours under nitrogen purge. The reaction was cooled, mixed with 500 cc of toluene and 100 cc of tetrahydrofuran and then washed once with 100 cc of 10 percent NaOH solution and twice with 250 cc of $H_2O$. The washed product was distilled to remove the solvents and unreacted dodecylaniline. The final stage of distillation was carried out to a pot temperature of 180° C and 3 mm Hg, where it was held for 2 hours. The yield of product was 509 grams and it contained 2.7 weight percent N and 2.94 weight percent S and had a total base number of 81. This product consisted mostly of trimer, tetramer and pentamer.

A 100 gram sample of the above product was diluted with 40 grams of process oil and then reacted with 5 grams of $Ca(OH)_2$ in 100 grams of methanol with $CO_2$ gas bubbling therethrough for 2 hours at 40°–50° C. The reaction mixture was then heated to remove the methanol and held at 150° C for 1 hour. The filtered overbased compound product contained 1.48 weight percent S.

EXAMPLE 2

A 100 gram sample of polydodecylaniline sulfide (50% active ingredient and 50% process oil), 25 cc of water and 3 grams of zinc oxide (ZnO) were mixed together and heated to gradually distill off the water. The mixture was held at about 150° C for 1 hour under atmospheric pressure and at 150° C for 1½ hours under house vacuum. The remaining residue was filtered through a funnel packed with hiflo filter aid on filter paper. The product filtrate weighed 80 grams. Chemical analysis of the product gave the following results in weight percent.

N — 2.51
S — 2.16
Zn — 0.81

A 50 gram quantity of the product filtrate of this example was then diluted with 20 grams of process oil and reacted with 2 grams of $Ca(OH)_2$ as in Example 1 to yield the oil-soluble overbased compound of this invention.

EXAMPLE 3

A 210 gram sample of the polydodecylaniline sulfide of Examples 2, 5 grams of zinc methane sulfonate and 40 grams of water were mixed together and heated to gradually distill off the water. The mixture was heated and filtered as in Example 2 and 185 grams of product filtrate was obtained. Chemical analysis of the product gave the following results in weight percent:

N — 2.44
S — 3.32
Zn — 0.68

A 100 gram sample of the product filtrate above prepared was then diluted with 40 grams of process oil and reacted with 5 grams of $Ba(OH)_2$ as in Example 1 to yield the oil-soluble overbased compound of this invention.

EXAMPLE 4

A 200 gram sample of the polydodecylaniline sulfide of Example 2, 20 grams of oleate and 25 cc of water were mixed together, heated and filtered as in Example 2. A total of 199.7 grams of product filtrate was obtained. Chemical analysis of the product gave the following results in weight percent:

N — 2.35
S — 2.44
Zn — 0.58

A 100 gram quantity of the above product filtrate was then diluted with 40 grams of process oil and reacted with 4 grams of $Ca(OH)_2$ as in Example 1. The oil-soluble overbased compound product was analyzed to contain 0.61 weight percent excess Ca, 0.54 weight percent S and 1.24 weight percent Zn.

EXAMPLE 5

A 110 gram sample of zinc polypropylphenylphosphate, 55 grams of the polydodecylaniline sulfide of Example 2 and 40 cc of water were mixed, heated and filtered as in Example 2. A total of 160.7 grams of product filtrate was obtained. Chemical analysis of the product gave the following results in weight percent:

N — 0.73
S — 0.80
Zn — 0.72

A 50 gram quantity of the above product filtrate was then diluted with 20 grams of process oil and reacted with 2.5 grams of $Ca(OH)_2$ as in Example 1 to yield the overbased compound of the present invention.

EXAMPLE 6

A 100 gram (50 percent active) sample of dodecylaniline sulfide (prepared by reacting two moles of dodecylaniline hydrochloride with 1 mole $SCl_2$) was mixed with 50 ml of water and 5 grams of zinc methane sulfonate. The reaction mixture was heated at reflux for 1 hour, then at 150°–160° C to remove all water. It was held at 160°–170° C under house vacuum and nitrogen for 1½ hours. The resulting mixture was filtered as in Example 2. A total of 89 grams of product filtrate was obtained which had a chemical analysis, in weight percent as follows:

N — 2.50
S — 3.40
Zn — 0.70

A 50 gram sample of the above product filtrate was then diluted with 20 grams of process oil and reacted with 2.5 grams of $Ba(OH)_2$ as in Example 1 to yield the present overbased compound.

EXAMPLE 7

A 50 percent active 100 gram sample of polydodecylaniline sulfide (prepared by the reaction of six moles of dodecylaniline hydrochloride and five moles of $SCl_2$) was mixed with 50 ml. of water and 5 grams of zinc methane sulfonate. The reaction mixture was heated and filtered as in Example 2 to yield 83 grams of product filtrate. Chemical analysis of the product proved it to have 0.6 weight percent zinc.

A 50 gram sample of the above product filtrate was then diluted with 20 grams of process oil and reacted with 2.5 grams of $Ca(OH)_2$ as in Example 1 to yield the present overbased compound.

EXAMPLE 8

A 50 percent active 100 gram sample of a compound prepared by reacting five moles of dodecylaniline hydrochloride and three moles of N,N-dimethylaniline hydrochloride with seven moles of $SCl_2$ was mixed with 50 ml. of water and 6 grams of zinc acetate. The reaction mixture was heated and filtered as in Example 3 to yield 85 grams of product filtrate which had a zinc content in weight percent of 0.7.

A 50 gram quantity of the above product filtrate was then diluted with 20 grams of process oil and reacted with 2.5 grams of $Ba(OH)_2$ as in Example 1 to yield the overbased compound of the present invention.

The antioxidant properties of the overbased compounds of this invention were measured by adding these compounds to a suitable oil and subjecting the oil to oxidation at high temperatures. The test was a bulk oil catalytic oxidation process in which a stream of dry air was passed through a heated sample of the lubricant composition for a time at various elevated temperatures in the presence of iron, copper, aluminum and lead as catalysts. The metal samples consisted of 15.6 square inches of sand-blasted iron wire, 0.78 square inches of polished copper wire, 0.87 inches of polished aluminum wire, and 0.167 square inches of polished lead surface. The antioxidant activity was evaluated as the ability of the additive to control the acid number (NN) and viscosity (KV) of the oil and to prevent them from rising at an unduly rapid rate. The sludge formation during the oxidation was estimated visually.

The base stocks used in this evaluation were a synthetic ester oil lubricant (made by reacting pentaerythritol with an equimolar mixture of $C_5$ and $C_9$ monocarboxylic acids) and a solvent refined paraffinic neutral oil stock having the following properties:

Pour, ° F — 20
SSU at 100° F — 130
SSU at 210° F — 42
VI, min. — 115

Results of this evaluation for sample compounds of this invention are tabulated below in Table I.

TABLE I

OXIDATION TEST OF PRESENT COMPOUNDS IN BASE STOCKS

| Compound of Example | Conc. Wt.% | Temp. ° F | ΔNN | %ΔKV | Sludge |
|---|---|---|---|---|---|
| *Base Oil | — | 425 | 4.6 | 300 | Moderate |
| 1 | 1 | 425 | 3.1 | 100 | Trace |
| **Base Oil | — | 375 | 12.1 | 400 | Heavy |
| 1 | 1 | 375 | 5.7 | 150 | Moderate |

*Synthetic ester oil lubricant.
**Solvent refined paraffinic neutral oil stock.

The high temperature detergency properties of the overbased compounds of this invention have been measured in the Diesel Oil Deposit Simulator Test, the procedure of which was as follows:

A test oil blend comprising a 150 SSU solvent refined mineral oil containing an additive package comprised of overbased sulfonate, overbased phenate and zinc dithiophosphate and an amount of the overbased compound of Example 4 herein being tested was preheated to 575° F and pumped into an oil reservoir in which an aluminum shaft was equipped to rotate at constant speed while partially immersed in the oil blend. The atmosphere of the reservoir was a gas mixture flowing at a controlled rate consisting of air mixed with nitrogen oxides and sulfur dioxide. This gas mixture had been previously mixed by passing the various gas streams through a fritted glass bubbler and then through a preheater whereby the mixture became saturated with water. This heated mixed gas stream was introduced into the reactor at a constant rate of 200 liters per hour and at 350° F. The shaft was maintained at a temperature of about 575° F throughout the duration of the test. The shaft was observed for deposit occasioned by the oxidation of the oil which became deposited upon the surface of the rotating shaft. Observations were made after 140 minutes. A rating of 100 indicates a clean surface.

The results of this evaluation are tabulated in Table II below.

TABLE II

DIESEL OIL DEPOSIT SIMULATOR TEST

| Compound of Example | Active Ingredient, wt. % | Rating at 140 Minutes |
|---|---|---|
| Base Oil | — | 60 |
| 4 | 2 | 85 |

What is claimed is:

1. An oil-soluble overbased compound obtained by the process comprising reacting a compound having the general chemical formula:

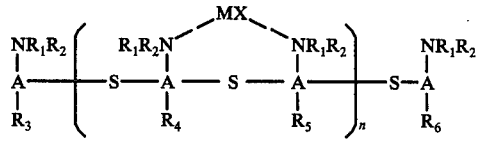

wherein

*n* is an integer of from 1 to about 10;
A is an aromatic hydrocarbon moiety;
M is a polyvalent metal selected from the group consisting of Be, Mg, Ca, Ba, Mn, Co, Ni, Pd, Cu, Zn and Cd;
X is oleate, acetate, oxide or sulfonate;

$R_1$ and $R_2$ are alkyl of from 1 to about 10 carbon atoms, aryl, $$-\overset{\overset{\displaystyle O}{\|}}{C}-R'$$

or combinations thereof;

R′ is alkyl of from 1 to about 10 carbon atoms, aryl or hydrogen;

$R_3$, $R_4$, $R_5$ and $R_6$ are hydrogen, alkyl of from 1 to about 200 carbon atoms, aryl, alkyl-substituted aryl where the alkyl substituent is comprised of from 1 to about 200 carbon atoms or combinations thereof with one or more basic metallic compounds selected from the group consisting of NaOH, LiOH, KOH, $Mg(OH)_2$, $Ca(OH)_2$, $Sr(OH)_2$and $Ba(OH)_2$ in the presence of $CO_2$ and alcohol.

2. The overbased compound of claim 1 wherein *n* is an integer of from 1 to about 5.

3. A lubricant composition comprising a major portion of an oil of lubricating viscosity or grease thereof and an oxidation property improving amount of the overbased compound of claim 1.

4. A lubricant composition comprising a major portion of an oil of lubricating viscosity or grease thereof and an oxidation property improving amount of the overbased compound of claim 2.

5. A lubricant composition comprising a major portion of an oil of lubricating viscosity or grease thereof and a detergency property improving amount of the overbased compound of claim 1.

6. A lubricant composition comprising a major portion of an oil of lubricating viscosity or grease thereof and a detergency property improving amount of the overbased compound of claim 2.

7. The composition of claim 3 comprising a major portion of an oil of lubricating viscosity.

8. The composition of claim 5 comprising a major portion of an oil of lubricating viscosity.

9. The composition of claim 3 comprising a major portion of a grease.

10. The composition of claim 5 comprising a major portion of a grease.

11. The composition of claim 7 wherein the oil of lubricating viscosity is a mineral lubricating oil.

12. The composition of claim 8 wherein the oil of lubricating viscosity is a mineral lubricating oil.

13. The composition of claim 7 wherein the oil of lubricating viscosity is a synthetic lubricating oil.

14. The composition of claim 8 wherein the oil of lubricating viscosity is a synthetic lubricating oil.

15. The composition of claim 13 wherein said synthetic lubricating oil is made from monopentaerythritol and a mixed $C_4$–$C_{10}$ aliphatic monocarboxylic acid.

16. The composition of claim 14 wherein said synthetic lubricating oil is made from monopentaerythritol and a mixed $C_4$–$C_{10}$ aliphatic monocarboxylic acid.

* * * * *